US006042444A

United States Patent [19]

Wang

[11] Patent Number: 6,042,444

[45] Date of Patent: Mar. 28, 2000

[54] METHOD FOR FABRICATING FIELD EMISSION DISPLAY CATHODE

[75] Inventor: Chih-Chong Wang, Chang-Hua, Taiwan

[73] Assignee: United Semiconductor Corp., Hsinchu, Taiwan

[21] Appl. No.: 09/322,055

[22] Filed: May 27, 1999

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,277,638 | 1/1994 | Lee | 445/24 |
| 5,827,100 | 10/1998 | Kim | 445/50 |
| 5,953,580 | 9/1999 | Kang et al. | 445/50 |
| 5,964,629 | 10/1999 | Park et al. | 445/24 |

*Primary Examiner*—Kenneth J. Ramsey
*Attorney, Agent, or Firm*—J. C. Patents; Jiawei Huang

[57] ABSTRACT

A method for fabricating a cathode of a field emission display. A doped polysilicon layer is formed over a substrate, and the doped polysilicon layer is patterned to form a plurality of field emitters. The doped polysilicon layer and the field emitters are patterned to form a plurality of field emission arrays. Then, a sharpening process is performed to form an oxide layer on the field emitters. A first dielectric layer and a second dielectric layer are formed conformal to the substrate, and a third dielectric layer is formed on the second dielectric layer. The third dielectric layer is planarized to expose the second dielectric layer on a top portion of each of the field emitters. The exposed second dielectric layer is removed, and an oxide layer is formed on the third dielectric layer and a top surface of the first dielectric layer on the top portion of the field emitter. A self-aligned metal layer is formed on the oxide layer. A portion of the self-aligned metal layer is removed to expose the oxide layer on the top portion of the field emitter, and gates are formed on the third dielectric layer. The exposed oxide layer and the first dielectric layer on the top portion of the field emitter are removed.

18 Claims, 5 Drawing Sheets

METHOD FOR FABRICATING FIELD EMISSION DISPLAY CATHODE

BACKGROUND OF THE INVENTION

1. Field of the Invention

The present invention relates to a method for fabricating a field emission display (FED) cathode. More particularly, the present invention relates to a method for fabricating a field emission display cathode having a larger emission area.

2. Description of the Related Art

Since the field of multimedia is developing quickly, the user has a great demand for entertainment equipment. Conventionally, the cathode ray tube (CRT), which is a species of monitor, is commonly used. However, the cathode ray tube does not meet the needs of multimedia technology because the cathode ray tube has a large volume. Therefore, many flat panel display techniques such as liquid crystal display (LCD), plasma display panel (PDP) and field emission display (FED) have been recently developed. These display techniques can manufacture thin, light, short and small monitors; thus these techniques have become the mainstream monitor technology for the future.

Since the pixel circuit used in the field emission display is faster than that in the liquid crystal display, the optical response time of the field emission display is shorter. This also means that the field emission display has better display performance.

The field emission display has several advantages. It is thinner (about 2 to 10 cm), is lighter (less than 0.2 kg), has a wider view-angle (larger than 80°), is brighter (more than 150 cd/m$^2$), has a large working temperature range (about −50° C. to 80° C.), consumes less energy (less than 1 W), etc. Furthermore, the manufacturing costs of the field emission display are low.

The field emission display works in a high vacuum environment. By using a strong electric field, electrons in the field emission array (FEA) are emitted, and the electrons impact electroluminescent materials. A catholuminescence effect occurs, so that an image is formed.

FIGS. 1A through 1D are schematic, cross-sectional views showing the progression of the conventional manufacturing steps for a field emission display cathode.

Referring to FIG. 1A, an epitaxial silicon substrate 10 is provided. An oxide layer (not shown) is formed by thermal oxidation on the epitaxial silicon substrate 10, and then the oxide layer is defined by photolithography to form a patterned oxide layer 12.

Referring to FIG. 1B, a portion of the epitaxial silicon substrate 10 is removed by isotropic wet etching. A thermal process is performed to form an oxide layer 15 on surface of the epitaxial silicon substrate 10.

Referring to FIG. 1C, the patterned oxide layer 12 (FIG. 1B) and the oxide layer 15 (FIG. 1B) are removed to form tips 14, and an oxide layer 16 is formed by chemical vapor deposition to cover the epitaxial silicon substrate 10 and the tips 14. A metal layer 18 is formed on the oxide layer 16, and then a patterned photoresist layer 20 is formed on the metal layer 18. Then, the metal layer 18 is etched with the photoresist layer 20 serving as a mask to expose the oxide layer 16.

Referring to FIG. 1D, a buffer oxide etching process is performed to remove a portion of the oxide layer 16, and then the tips 14 are exposed. The photoresist layer 20 (FIG. 1C) is removed. Now, the tips 14 serve as field emitters, the metal layer 18 serves as a gate and the whole epitaxial silicon substrate 10 serves as a bottom plate, or a cathode plate, of a field emission display.

Moreover, the field emission display includes a top plate (not shown), or an anode plate, wherein the top plate includes a glass plate coated with phosphorus. Spacers are located between the top plate and the bottom plate. The field emitters on the bottom plate constitute field emission arrays. By the electric field supplied by the gate, the field emitter excites electrons to generate an electron beam. The electrons are accelerated by positive voltage of the anode plate, so that the electrons impact the phosphorus on the anode plate to generate a catholuminescence effect.

In the conventional technology, the emitter for the field emission array is designed to have a tip according to a point discharge characteristic. However, electrons are only emitted from the tip portion of each emitter, thus the amount of electrons is restricted. As a result, each pixel of the field emission display must comprise hundreds of emitters to produce enough electron flow for impacting the phosphorus on the anode plate to generate the catholuminescence effect. As a result, the area occupied by the field emission array is large. Furthermore, the emitter in the conventional technology is formed on the epitaxial silicon substrate. Because of the uniformity of the epitaxial silicon, it is difficult to manufacture large-size displays.

SUMMARY OF THE INVENTION

The present invention provides a method for fabricating a cathode of a field emission display. The interval between the gate and the field emitter is reduced. Therefore, the method can enhance electron flow excited from the field emitter, reduce parasitic capacitance between the gate and a substrate, and improve performance of the field emission display.

To achieve these and other advantages and in accordance with the purpose of the invention, as embodied and broadly described herein, the invention provides a method for fabricating a cathode for a field emission display. A doped polysilicon layer is formed over a substrate, and the doped polysilicon layer is patterned to form a plurality of field emitters. The doped polysilicon layer and the field emitters are patterned to form a plurality of field emission arrays. Then, a sharpening process is performed to form an oxide layer on the field emitters. A first dielectric layer and a second dielectric layer are formed conformal to the substrate, and a third dielectric layer is formed on the second dielectric layer. The third dielectric layer is planarized to expose the second dielectric layer on a top portion of each of the field emitters. The exposed second dielectric layer is removed, and an oxide layer is formed on the third dielectric layer and a top surface of the first dielectric layer on the top portion of the field emitter. A self-aligned metal layer is formed on the oxide layer. A portion of the self-aligned metal layer is removed to expose the oxide layer on the top portion of the field emitter, and gates are formed on the third dielectric layer. The exposed oxide layer and the first dielectric layer on the top portion of the field emitter are removed.

In the invention, the electric field between the gate and the field emitter is enhanced and the electron flow excited from the field emitter is increased because of the planarized dielectric layer between the gate and the polysilicon layer. Furthermore, the parasitic capacitance between the gate and the polysilicon layer is reduced, and the performance of the display is also improved.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
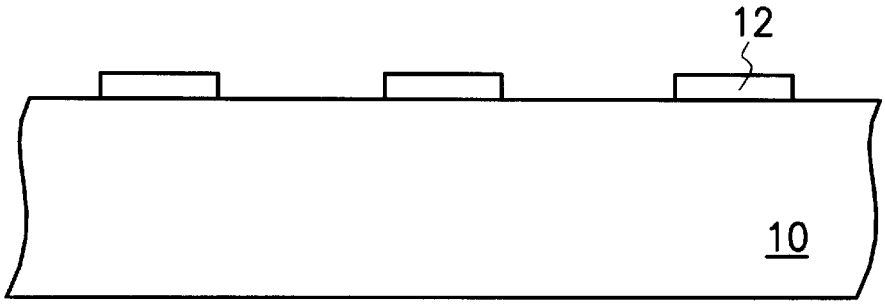
FIG. 1A (PRIOR ART)
FIGS. 1A through 1D are schematic, cross-sectional views showing the progression of the conventional manufacturing steps for a field emission display cathode.
Figure 1B:
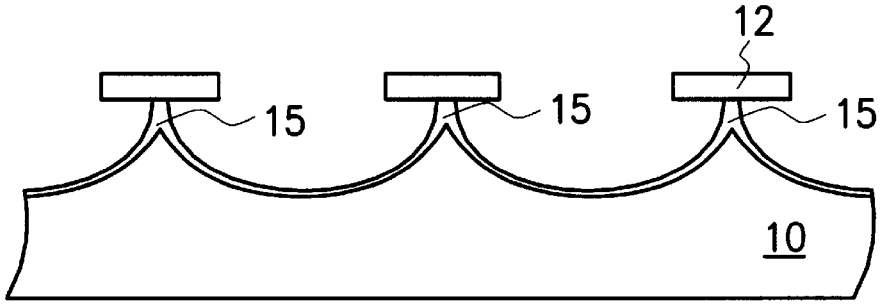
FIG. 1B (PRIOR ART)
Figure 1C:
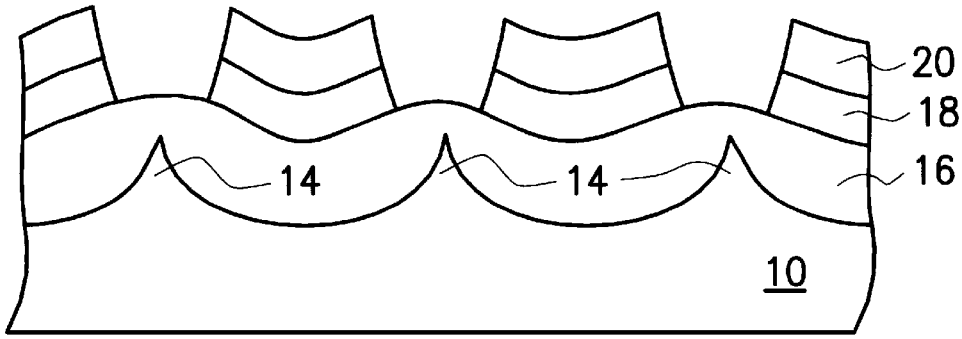
FIG. 1C (PRIOR ART)
Figure 1D:
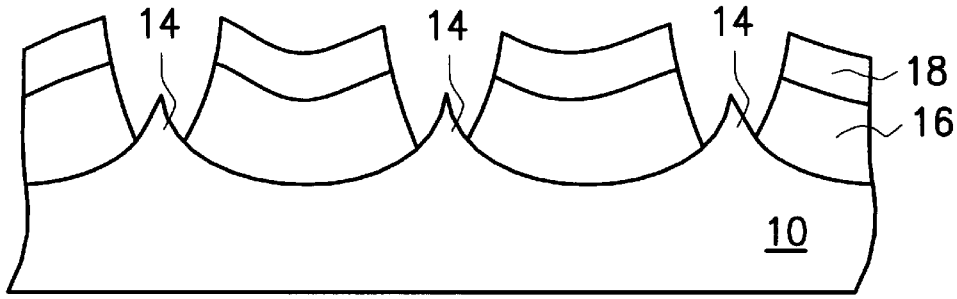
FIG. 1D (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

FIGS. 2A through 2I are schematic, cross-sectional views showing the progression of the manufacturing steps for a field emission display cathode in accordance with the preferred embodiment of the present invention.

Figure 2A:
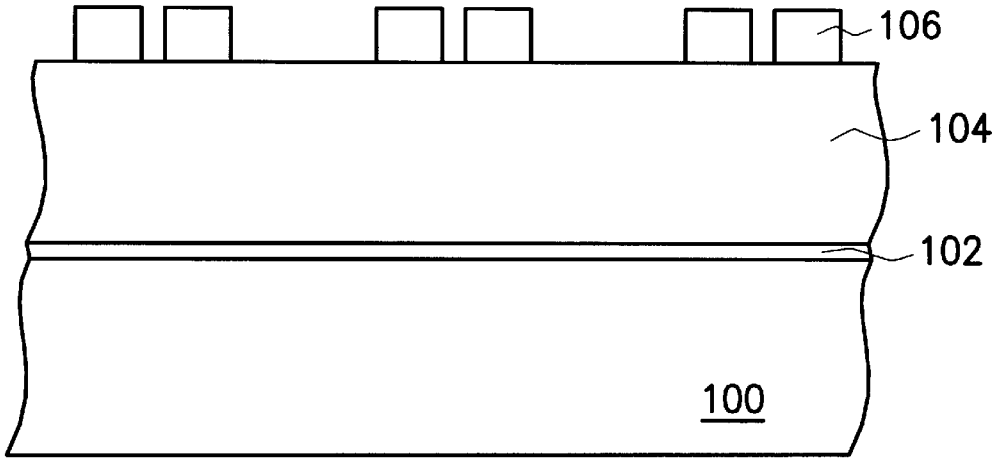
FIGS. 2A through 2I are schematic, cross-sectional views showing the progression of the manufacturing steps for a field emission display cathode in accordance with the preferred embodiment of the present invention.

Referring to FIG. 2A, a substrate 100 is provided. The substrate 100 is made from a material such as glass. A pad oxide layer 102 is formed on the substrate 100, and then a doped polysilicon layer 104 is formed, for example, by chemical vapor deposition on the pad oxide layer 102. In the invention, the doped polysilicon layer 104 is used to form a field emitter. By comparison with the epitaxial silicon used in prior art, the process for forming the polysilicon layer 104 is easily controlled and uniformity of the polysilicon layer 104 is better. Therefore, it is suitable for manufacturing large-size displays. A patterned photoresist layer 106 is formed by photolithography on the doped polysilicon layer 104 to cover regions for forming a field emitters.

Figure 2B:
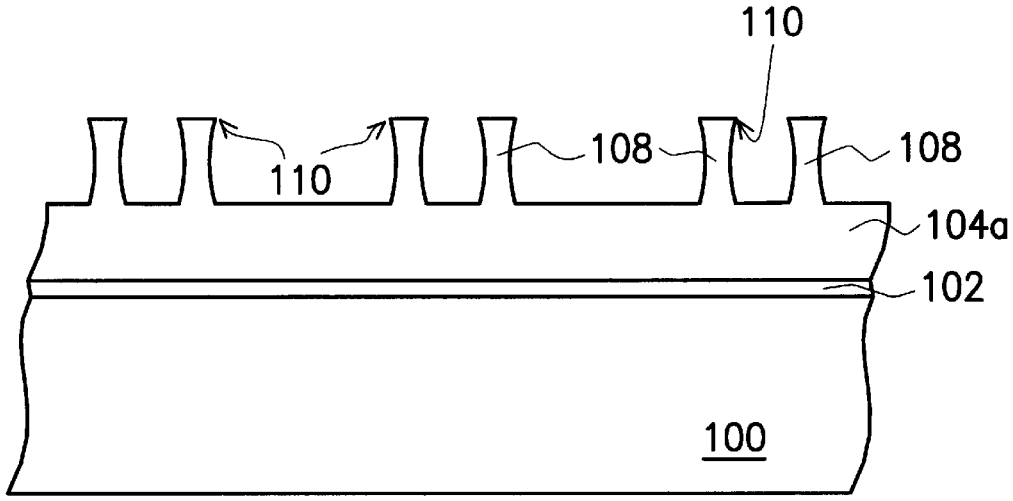

Referring to FIG. 2B, with the patterned photoresist layer 106 as a mask, a thickness of the doped polysilicon layer 104 is removed to form a plurality of field emitters 108, while the remaining doped polysilicon layer 104*a* is sufficiently thick to cover the pad oxide layer 102. Both the field emitters 108 and the remaining doped polysilicon layers 104*a* are made of the doped polysilicon layer 104 (FIG. 2A) by an combining etching step which includes a dry etching step such as an anisotropic etching process and a wet etching step such as an isotropic etching process. The field emitters 108 are located on the remaining doped polysilicon layer 104*a*. The patterned photoresist layer 106 (FIG. 1) is removed. By the combining etching step, the field emitter 108 is formed with an chimney shaped lumps on the doped polysilicon layer 104*a*. Each of the field emitter 108 has a top corner with an acute angle. That is, the field emitter 108 has a top surface and a sidewall intersect with each other with an acute angle 110. Since the angle 110 is acute, the entire upper rim of the field emitter 108 can emit electrons according to the spike charge characteristic. As a result, each of the field emitters 108 has larger emission area, so that the electron flow emitted from the field emitter 108 is increased.

Figure 2C:
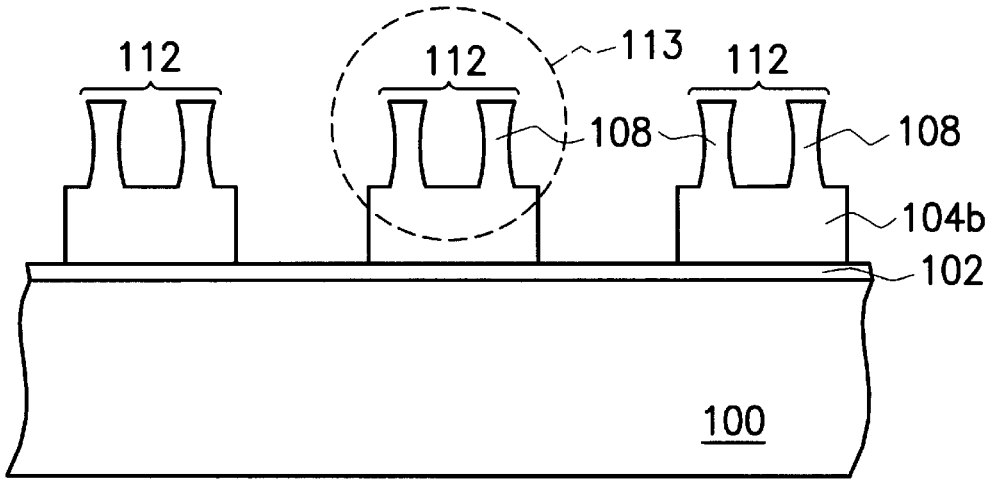

Referring to FIG. 2C, a patterned photoresist layer (not shown) is formed by photolithography on the doped polysilicon layer 104*a* to cover a region for forming a field emission array. A portion of the remaining doped polysilicon layer 104*a* is removed by using the patterned photoresist layer as an etching mask to expose the pad oxide layer 102. A field emission array 112 is formed having each single unit 113 of the field emitters 108 is isolated with each other. The patterned photoresist layer is removed. As can be seen from FIG. 2C, each single unit 113 of the field emission arrays 112 contains many field emitters 108 and a patterned doped polysilicon layer 104*b*.

Figure 2D:
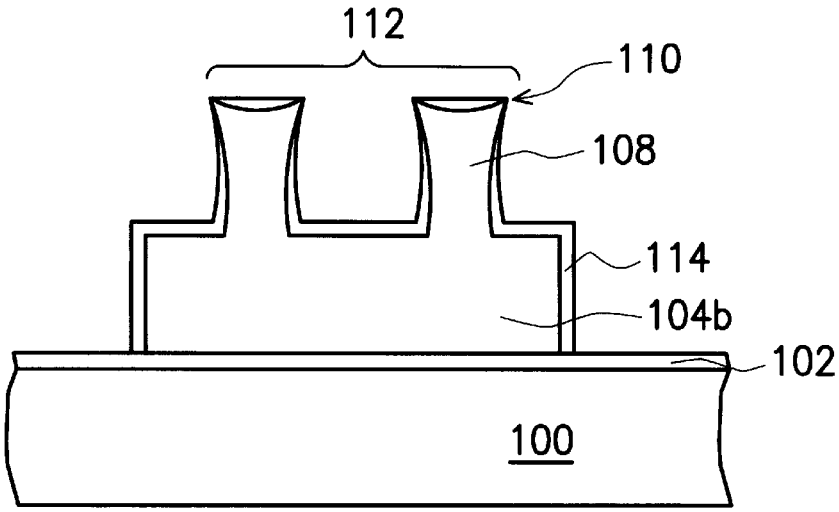

An enlarged view of the single unit 113 of the field emitter array 112 is shown in FIG. 2D with a further description as follows.

Referring to FIG. 2D, a thermal oxidation process is performed on the field emitters 108 at about 700–900° C. to form an oxide layer 114. Because of the oxidation characteristic, the angle 110 is oxidized with difficulty at low temperature. As a result, a profile of the oxide layer 114 is shown in FIG. 2D, and then the oxide layer 114 is removed. Therefore, the angle 110 is sharper than it used to be. The sharper angle 110 can enhance the electric field to increase an ability of point discharge.

Figure 2E:
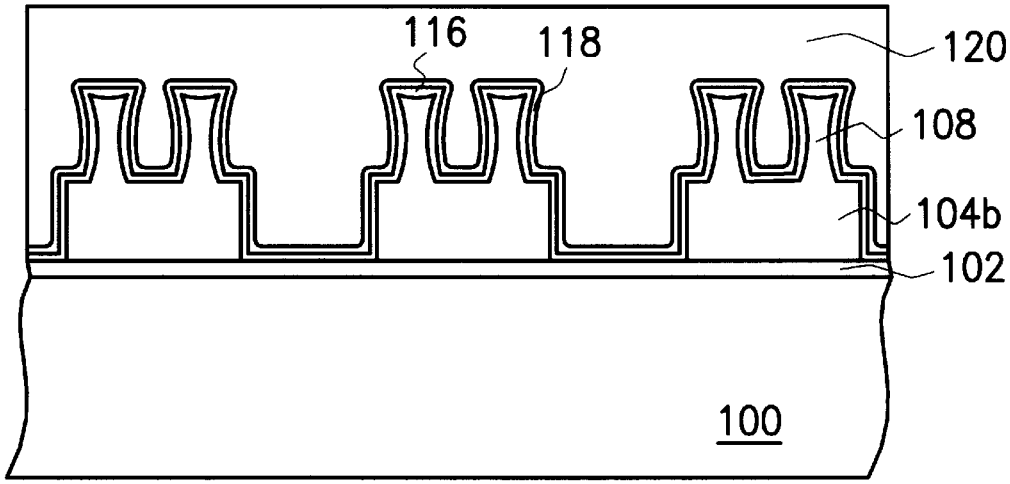

Referring to FIG. 2E, a conformal gate oxide layer 116 is formed, for example, by thermal oxidation over the substrate 100. A conformal dielectric layer 118 is formed, for example, by low-pressure chemical vapor deposition on the gate oxide layer 116. The dielectric layer 118 is made of a material such as silicon nitride. A dielectric layer 120 is formed, for example, by chemical vapor deposition or high-density plasma chemical vapor deposition over the substrate 100 to cover the field emitter arrays 112 fully. The dielectric layer 120 is made of a material such as silicon oxide.

Figure 2F:
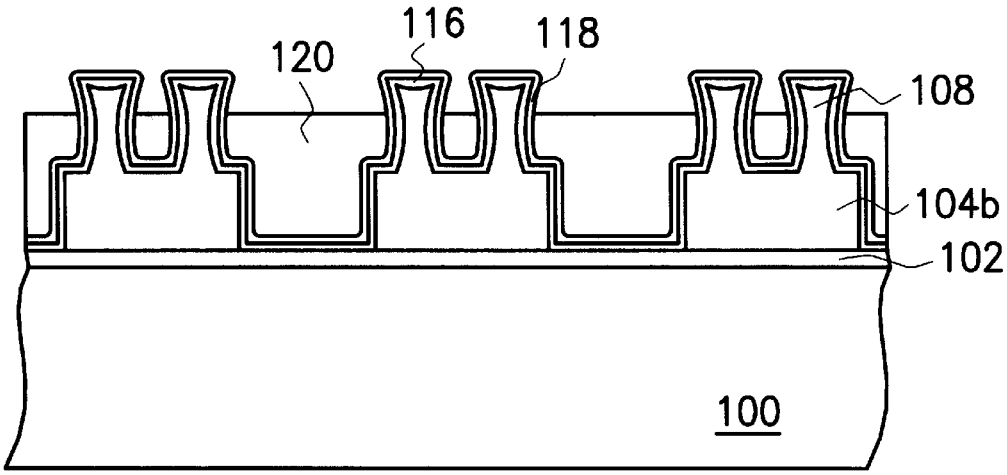

Referring to FIG. 2F, the dielectric layer 120 is planarized by chemical mechanical polishing (CMP) with the dielectric layer 118 serving as a stop layer. Because the material of the dielectric layer 120 is softer than that of the dielectric layer 118, the surface of the dielectric layer 120 is lower than that of the dielectric layer 118 by adjusting the time of chemical mechanical polishing. As a result, a top portion of the field emitter 108 is higher than the surface of the dielectric layer 120.

Figure 2G:
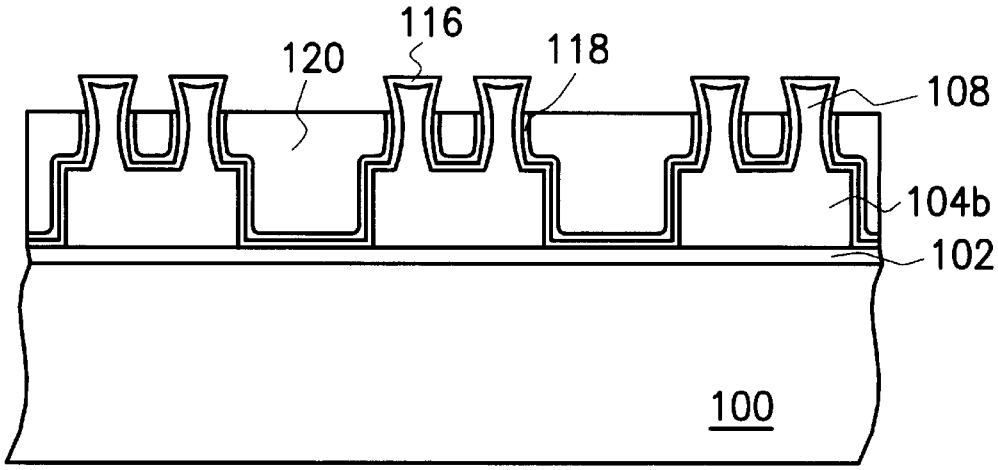

Referring to FIG. 2G, after removing the portion of the dielectric layer 120, the exposed dielectric layer 118 is removed, for example, by using hot phosphoric acid as an etchant. The gate oxide layer 116 on the top portion of the field emitter 108 is exposed.

Figure 2H:
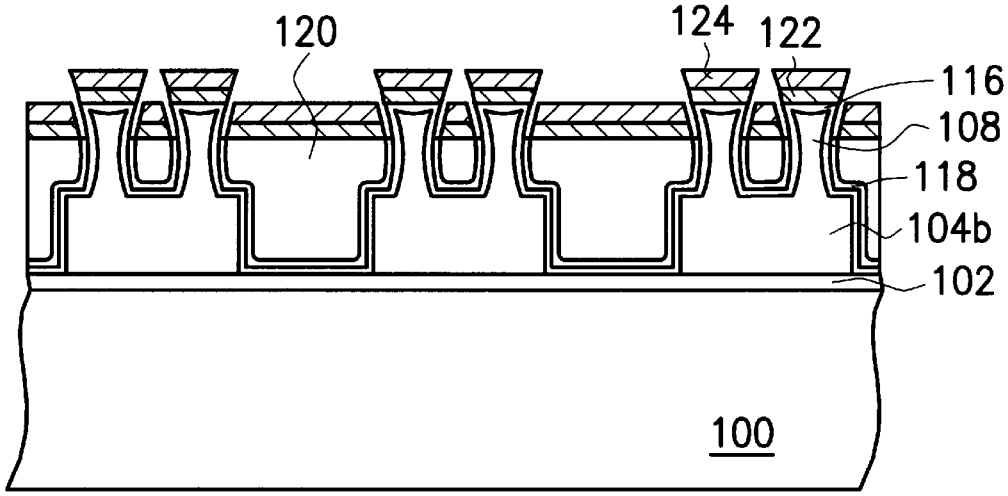

Referring to FIG. 2H, an oxide layer 122 is formed on a top surface of the gate oxide layer 116 and the dielectric layer 120. The oxide layer 122 is formed, for example, by E-gun chemical vapor deposition. Because the E-gun chemical vapor deposition has poor step coverage ability, the oxide layer 122 is only formed on the top surface of the gate oxide layer 116 and the dielectric layer 120. Namely, the oxide layer 122 is divided. A self-aligned metal layer 124 is formed, for example, by sputtering on the oxide layer 122. The self-aligned metal layer 124 is formed by adjusting a sputtering angle. The sputtering direction is almost parallel to the substrate 100 surface. As a result, the step coverage ability of the metal layer 124 is poor, so that the self-aligned metal layer 124, which aligns with the oxide layer 122, is formed.

Figure 2I:
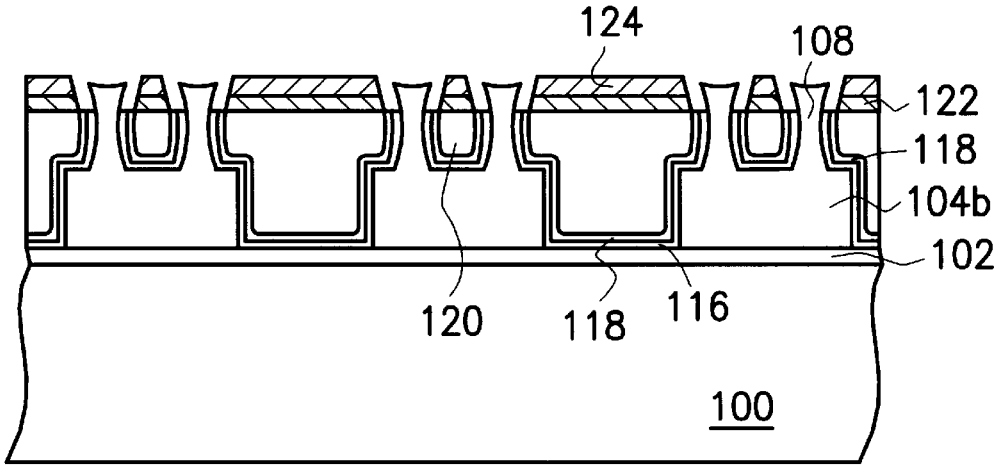

Referring to FIG. 2I, a portion of the metal layer 124 on the top portion of the field emitter 108 is removed, for example, by photolithography and etching. The metal layer 124 on the surface of the oxide layer 122 is remained. The remaining metal layer 124 surrounds the field emitter 108 for serving as gates. The exposed oxide layer 122 and the gate oxide layer 116, which are located on the top portion of the field emitter 108, are removed by, for example, buffer oxide etching.

Figure 3:
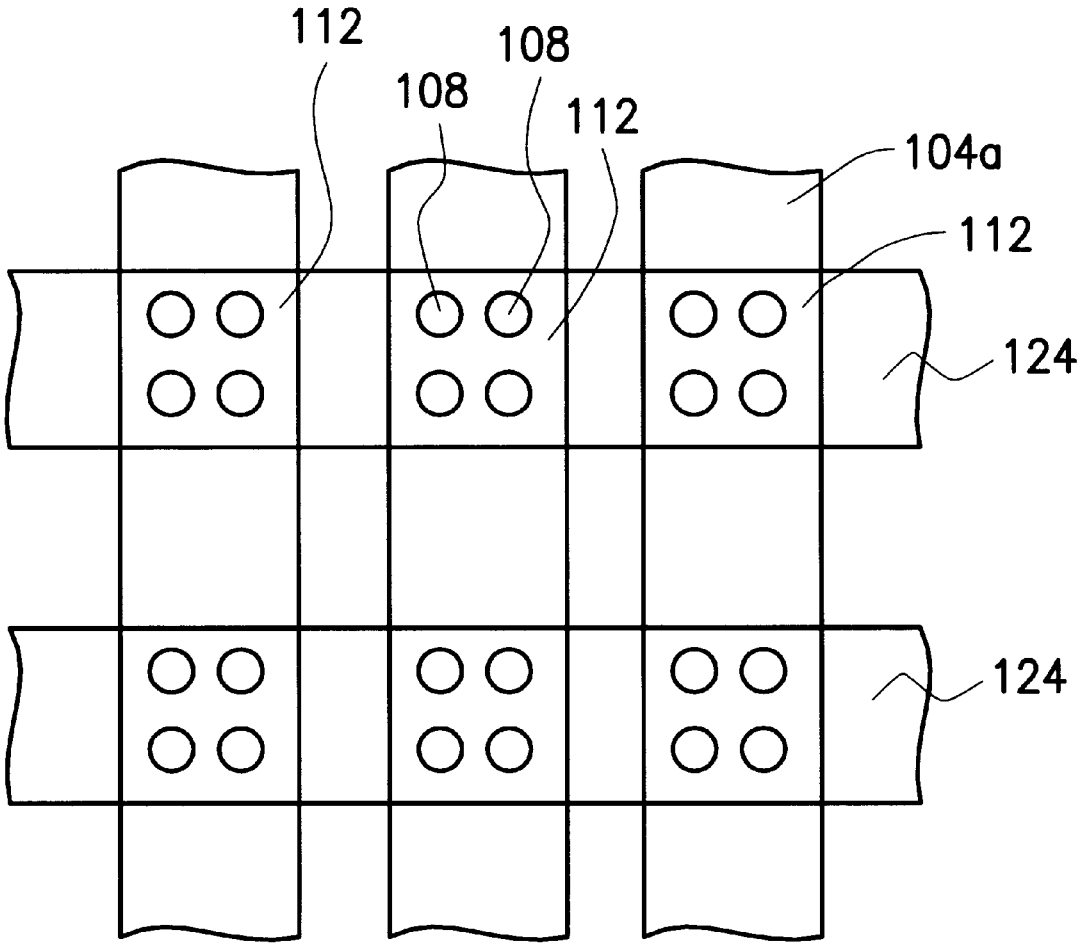
FIG. 3 is a schematic, top view showing the field emission display cathode in accordance with the preferred embodiment of the present invention.

FIG. 3 is a schematic, top view showing a field emission display cathode in accordance with the preferred embodiment of the present invention. The field emission display cathode includes a plurality of field emission arrays 112. Each of the field emission arrays 112 contains a plurality of field emitters 108 and metal layer 124 around the field emitter 108.

The invention provides a method for fabricating a field emission display cathode. The dielectric layer between the gate and the polysilicon layer is planarized, so that the interval between the gate and the field emitter is reduced. Therefore, the method can enhance an electric field between the gate and the field emitter to increase electron flow excited from the field emitter.

The invention provides a method for fabricating a field emission display cathode. Because the dielectric layer between the gate and the polysilicon layer is planarized, a thickness of the dielectric layer is easily controlled and is highly uniform. The method can reduce parasitic capacitance and improve performance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for fabricating a field emission display cathode, the method comprising the steps of:

forming a pad oxide layer on a substrate;

forming a doped polysilicon layer on the pad oxide layer;

patterning a part of the doped polysilicon layer to form a plurality of field emitters on top of the remaining doped polysilicon layer, wherein each of the field emitters has an chimney shape with a top surface and a sidewall meeting other with an acute angle;

patterning the remaining doped polysilicon layer under the field emitters to form a plurality of field emission arrays, wherein each of the field emission arrays has at least one field emitter;

performing a sharpening process to sharpen the acute angle between the top surface and the sidewall of each field emitter;

forming a first dielectric layer and a second dielectric layer over the substrate in sequence, wherein the first dielectric layer and the second dielectric layer are conformal to the field emitters and the doped polysilicon layer;

forming a third dielectric layer on the second dielectric layer;

planarizing the third dielectric layer to expose the second dielectric layer on a top portion of each of the field emitters;

removing the exposed second dielectric layer;

forming an oxide layer on the third dielectric layer and a top surface of the first dielectric layer on the top portion of the field emitter;

forming a self-aligned metal layer on the oxide layer;

removing a portion of the self-aligned metal layer to expose the oxide layer on the top portion of the field emitter, wherein the remaining self-aligned metal layer is serving as a plurality of gates; and removing the exposed oxide layer and the first dielectric layer on the top portion of the field emitter.

2. The method of claim 1, wherein the step of forming the field emitters further comprises:

forming a photoresist layer over a portion of surface of the doped polysilicon layer;

performing an isotropic etching process and an anisotropic etching process to remove a portion of the doped polysilicon layer; and removing the photoresist layer.

3. The method of claim 1, wherein the sharpening process further comprises:

performing a thermal oxidation process to oxidize the field emitters, so as to form an oxide layer on a surface of the field emitters; and removing the oxide layer.

4. The method of claim 3, wherein a temperature in the thermal oxidation process is about 700–900° C.

5. The method of claim 1, wherein the first dielectric layer includes silicon oxide.

6. The method of claim 5, wherein the step of forming the first dielectric layer includes using thermal oxidation.

7. The method of claim 1, wherein the second dielectric layer includes silicon nitride.

8. The method of claim 7, wherein the step of forming the second dielectric layer includes using low-pressure chemical vapor deposition.

9. The method of claim 1, wherein the third dielectric layer includes silicon oxide.

10. The method of claim 9, wherein the step of forming the third dielectric layer includes using chemical vapor deposition.

11. The method of claim 10, wherein the step of forming the third dielectric layer includes using high-density plasma chemical vapor deposition.

12. The method of claim 1, wherein the step of planarizing the third dielectric layer includes performing a chemical-mechanical polishing process with the second dielectric layer serving as a stop layer.

13. The method of claim 1, wherein the step of forming the oxide layer includes E-gun chemical vapor deposition.

14. The method of claim 1, wherein the step of removing the oxide layer and the first dielectric layer includes using buffer oxide etching.

15. A method for fabricating a field emission display cathode, the method comprising the steps of:

forming a pad oxide layer on a substrate;

forming a doped polysilicon layer on the pad oxide layer;

patterning a part of the doped polysilicon layer to form a plurality of field emitters on top of the remaining doped polysilicon layer, wherein each of the field emitters has an chimney shape with a top surface and a sidewall meeting other with an acute angle;

patterning the remaining doped polysilicon layer under the field emitters to form a plurality of field emission arrays, wherein each of the field emission arrays has at least one field emitter;

performing a thermal oxidation process to form a first oxide layer on a surface of the field emission arrays;

removing the first oxide layer, so as to the field emitters are sharpened;

forming a first dielectric layer and a second dielectric layer over the substrate in sequence, wherein the first dielectric layer and the second dielectric layer are conformal to the field emitters and the doped polysilicon layer;

forming a third dielectric layer on the second dielectric layer;

planarizing the third dielectric layer to expose the second dielectric layer on a top portion of each of the field emitters;

removing the exposed second dielectric layer;

forming a second oxide layer on the third dielectric layer and a top surface of the first dielectric layer on the top portion of the field emitter;

forming a self-aligned metal layer on the second oxide layer;

removing a portion of the self-aligned metal layer to expose the second oxide layer on the top portion of the field emitter, wherein the remaining self-aligned metal layer is serving as a plurality of gates; and removing the exposed second oxide layer and the first dielectric layer on the top portion of the field emitter.

16. The method of claim 15, wherein the step of forming the field emitters further comprises:

forming a photoresist layer over a portion of surface of the doped polysilicon layer;

performing an isotropic etching process and an anisotropic etching process to remove a portion of the doped polysilicon layer; and removing the photoresist layer.

17. The method of claim 15, wherein a temperature in the thermal oxidation process is about 700–900° C.

18. A method for forming a field emitter, the method comprising the steps of:

forming a pad oxide layer on a substrate;

forming a doped polysilicon layer on the pad oxide layer;

forming a photoresist layer over a portion of surface of the doped polysilicon layer;

performing an etching process, wherein the etching process includes an isotropic etching process and an anisotropic etching process to remove a portion of the doped polysilicon layer, so that field emitters are formed and each of the field emitters has an chimney shape with a top surface and a sidewall meeting other with an acute angle; and removing the photoresist layer.

* * * * *